United States Patent [19]

Chen

[11] Patent Number: 4,597,366

[45] Date of Patent: Jul. 1, 1986

[54] FIELD-INTERRUPTING CONTACTLESS IGNITION SYSTEM FOR INTERNAL COMBUSTION ENGINE

[76] Inventor: Jack C. Chen, 120 Spruce St., Wood Dale, Ill. 60191

[21] Appl. No.: 758,317

[22] Filed: Jul. 24, 1985

[51] Int. Cl.[4] ..... F02P 1/00

[52] U.S. Cl. ..... 123/146.5 A; 200/19 R; 200/19 DR; 123/643; 123/650

[58] Field of Search ..... 123/146.5 A, 643, 650; 200/19 R, 19 DR

[56] References Cited

U.S. PATENT DOCUMENTS

| | | | |
|---|---|---|---|
| 2,444,325 | 6/1948 | Arthur | 200/19 DR |
| 3,019,276 | 1/1962 | Harlow | 123/146.5 A |
| 3,210,586 | 10/1965 | Clovett, Jr. | 200/19 DR |
| 3,336,457 | 8/1967 | Julian et al. | 200/19 DR |
| 3,799,135 | 3/1974 | House | 123/146.5 A |
| 3,894,202 | 7/1975 | Campbell et al. | 123/146.5 A |
| 3,941,107 | 3/1976 | Rockwell | 123/146.5 A |
| 4,235,213 | 11/1980 | Jellisson | 123/146.5 A |
| 4,342,292 | 8/1982 | House et al. | 123/146.5 A |
| 4,488,530 | 12/1984 | Turatsky | 123/146.5 A |

*Primary Examiner*—Raymond A. Nelli

*Attorney, Agent, or Firm*—Arno Wm. Lemke

[57] ABSTRACT

An apparatus for distributing a high voltage arc from the high voltage ignition coil of a piston type internal combustion engine to the respective spark plug terminals by means of a high resistance, field-interrupting dielectric device which has an aperture therethrough defining a conductive path through the non-conductive dielectric device. The device is rotated in a fixed gap between the fixed location high voltage ignition coil electrode and the opposing spark plug terminal electrodes in such a manner so as to cause the aperture therethrough to pass directly between the electrodes which in turn allows a high voltage arc to bridge the fixed gap between the electrodes thus causing the spark plugs to be fired. When the aperture is not present in the fixed gap between the electrodes, the high resistance dielectric material of the device interrupts the electrical field between the electrodes, thus preventing an arc from bridging the gap and the spark plugs from being fired. The rotation of the device in the gap is synchronized to the rotation of the engine camshaft by means of a step motor, motor controller, sensors, and electronic circuitry, to insure that the aperture is present and the spark is allowed to bridge the gap to the respective spark plug terminals and cause the respective spark plugs to be fired in the proper sequential manner, without any mechanical linkage between the engine camshaft and the rotating distribution device.

7 Claims, 8 Drawing Figures

FIELD-INTERRUPTING CONTACTLESS IGNITION SYSTEM FOR INTERNAL COMBUSTION ENGINE

BACKGROUND OF THE INVENTION

1. Field of the Invention

The disclosed invention relates to ignition systems in general, and particularly to ignition systems as applied to internal combustion engines. More specifically, it relates to an ignition system for a piston type internal combustion engine as contrasted with a turbine type of engine, and specifically to the distributor of the ignition system.

2. Description of the Prior Art

Existing art distributor type ignition systems for piston type internal combustion engines basically fall into the following two categories: (1) conventional distributors having a rotating conductor arm (rotor) which transmits voltage from the high voltage electrode of the ignition coil to the respective spark plug terminals via means of a rotating conductor which is in direct contact with the high voltage electrode of the ignition coil and is rotated in close proximity with each spark plug terminal to allow a voltage arc to occur between the rotating arm (rotor) and the terminal of the spark plug designated to be fired via means of a mechanical linkage between the engine camshaft and the rotor; and (2) a contactless ignition system which uses an electronic controller to analyze the signal generated by a sensor in order to determine the correct firing sequence of the spark plugs.

The first type of conventional system has presented numerous problems related to (a) the minimum size of the distributor required to provide the amount of high voltage insulation necessary to prevent misfiring of the spark plugs, to (b) the limits placed upon the physical location of the distributor which must be mechanically linked to the engine camshaft, to (c) the relatively high cost of providing the required mechanical link to the engine camshaft, to (d) the extremely high amount of service and maintenance that is required to keep the system operating within acceptable tolerance levels.

The second type of contactless ignition system was designed to correct the known problems with the first type and typically utilizes either multiple ignition coils or a single coil with multiple inputs and outputs to provide the high voltage spark necessary to fire the spark plugs. An electronic controller which receives a signal from a sensor which detects movement of the engine camshaft, analyzes the signal and determines the proper firing sequence for each of the spark plugs. The requirements of multiple ignition coils or coils with multiple inputs and outputs, and of needing a complex controller to analyze the signals and determine the proper firing sequence, result in high manufacturing costs. Additionally, each spark plug must be fired on both the compression and exhaust cycles, thus causing a decrease in the service life of the spark plugs which in turn increases the maintenance costs of this type of contactless ignition system.

OBJECTS OF THE INVENTION

One object of the present invention is to furnish an improved contactless ignition system for piston type internal combustion engines which eliminates the known problems in the existing art of such ignition systems.

Another object of the present invention is to furnish an improved contactless ignition system according to the previous object wherein the rotating conductor arm (rotor) is eliminated.

Another object of the present invention is to furnish an improved contactless ignition system according to the previous objects wherein the high voltage electrode and the spark plug terminal electrodes are both in fixed positions opposing each other, separated by a fixed gap.

Another object of the present invention is to furnish an improved contactless ignition system according to the previous objects wherein a high resistance dielectric device having an aperture therethrough, is rotated in the gap between the high voltage electrode and the spark plug terminal electrodes thus allowing an arc to pass between the electrodes and to fire the spark plugs when the aperture is present, or of preventing an arc from passing between the electrodes when the high resistance dielectric material is present in the gap between the electrodes.

Another object of the present invention is to furnish an improved contactless ignition system according to the previous objects which eliminates any direct mechanical linkage between the engine camshaft and the rotating distribution device by means of driving the rotating device with a step motor which is synchronized with the rotation of the engine camshaft by means of a sensing device and electronic circuitry to insure that the spark plugs are fired at the appropriate time.

Another object of the present invention is to furnish an improved contactless ignition system according to the previous objects which requires the use of only one ignition coil and can be manufactured at lower costs than known contactless ignition systems.

Still another object of the present invention is to furnish an improved contactless ignition system according to the previous objects which will be more reliable and require less service and maintenance than known systems.

SUMMARY OF THE INVENTION

To accomplish these objects and others, the disclosed invention may provide a device manufactured of a high resistance dielectric material having an insulating strength of not less than 500 volts per 0.001 inch of thickness and having an aperture passing therethrough to provide a means of allowing a high voltage arc to pass through the device. This high resistance dielectric device may be rotated in a gap between the fixed location high voltage electrode connected to the ignition coil and the fixed location electrode terminals connected to the spark plugs of an internal combustion engine.

When this high resistance dielectric device is rotated in the gap between the fixed location electrodes of the ignition coil and the spark plug electrode terminals, the aperture therethrough provides a conductive path through the high resistance dielectric material thus allowing a high voltage arc to bridge the gap between the electrodes thus causing the respective spark plugs to be sequentially fired as the aperture passes between the electrodes. When the aperture is not between the electrodes, the high resistance dielectric material of the device prevents an arc from bridging the gap and the spark plugs can not fire.

The high resistance dielectric device may be manufactured having a plurality of concentric fin-type projections off one surface or both surfaces of the device which may be configured in such manner so as to increase or decrease the length of an alternate path for high voltage arcing to ground, or around the high resistance dielectric material of the device from the high voltage electrode connected to the ignition coil to the electrode terminals of the spark plugs. This alternate conductive path must be large enough to prevent arcing and misfiring of the respective spark plugs which should only fire when the aperture is present in the gap.

The high resistance dielectric device may be rotated in the gap between the high voltage electrode of the ignition coil and the spark plug electrode terminals by means of a step motor synchronized to the rotation of the engine camshaft to cause the aperture to be present in the gap and the appropriate spark plugs to be fired in the proper sequential manner.

A sensor means may be adapted to the engine camshaft to pick up timing signals which may be used to drive the step motor to insure proper synchronization between the engine camshaft and the rotating high resistance dielectric device.

The aperture passing through the high resistance dielectric device may be filled with a conductive material or may be void of any material, thus creating an air gap between the high voltage electrodes of the ignition coil and the spark plug terminals.

BRIEF DESCRIPTION OF THE DRAWINGS

Further objects, advantages and features of the present invention will be apparent from the following disclosure and description, which includes the accompanying drawings, in which.

DESCRIPTION OF PREFERRED EMBODIMENTS OF THE INVENTION

Figure 3:
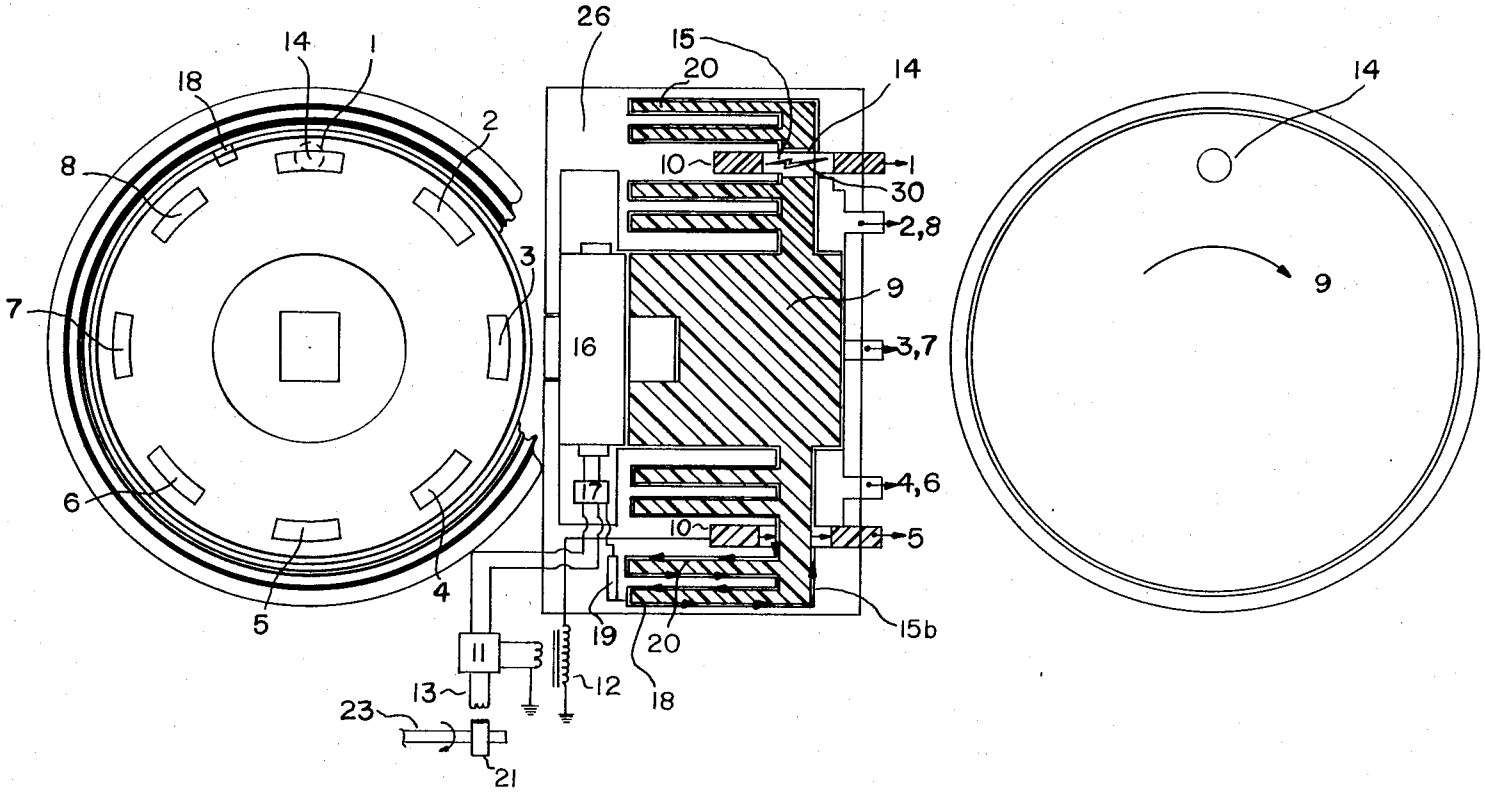
FIG. 3 is an enlarged fragmentary sectional view and diagramatic representation of one preferred embodiment of the disclosed high resistance, field-interrupting dielectric device shown in operative arrangement with a fixed location high voltage electrode connected to the ignition coil and fixed location electrode terminals connected to the spark plugs of an eight cylinder piston type internal combustion engine.

Shown in FIG. 3 is a grammatical representation of one preferred embodiment of the disclosed invention wherein the high voltage coil 12 of the ignition system is connected to a fixed location high voltage terminal 10 which is circular in shape and directly opposing each of eight electrode terminals 1, 2, 3, 4, 5, 6, 7, and 8, which are connected to the respective spark plugs 1–8 of an internal combustion engine. The high voltage terminal 10 connected to the high voltage ignition coil 12 is separated from the eight spark plug terminals 1–8, by a fixed gap 15, which defines the primary conductive arcing path 15*a*.

The disclosed high resistance dielectric device 9 is cylindrical in shape having a plurality of concentric fin-type of projections 20 off of one side of the device 9, which define a longer alternate high voltage arcing path 15*b* from the high voltage coil electrode 10 to either the overall distributor housing 26, which is grounded, or to the respective spark plug electrode terminals 1–8. This alternate conductive path 15*b* is not through the aperture 14 of the device 9.

An aperture 14 passing totally through the device 9 creates a window or conductive path 15*a* through the non-conductive dielectric material of the device 9 and defines the primary conductive arcing path 15*a* between the electrodes. The aperture 14 may be filled with a conductive material or may be void of any material other than air.

Device 9 is rotated through the fixed gap 15 by means of a step motor 16, which is synchronized to the rotation of the engine camshaft 23 to insure that the aperture 14 passing through the device 9, is correctly positioned in the gap 15 between the high voltage electrode 10 and the spark plug electrodes 1–8, when the respective spark plugs 1–8 are to be sequentially fired. When the aperture 14 is rotated through the fixed gap 15, a high voltage arc 30 is allowed to bridge the gap 15 between the high voltage coil electrode 10 and the respective opposing spark plug terminals 1–8, thus causing the respective spark plugs 1–8 to be fired in the proper sequential manner. However, when the aperture 14 is not present in the gap 15 between the high voltage electrode terminal 10 and the respective spark plug terminals 1–8, the high resistance dielectric material of the device 9 is present in the gap 15, and acts to interrupt the electrical field between the high voltage electrode terminal 10 and the respective spark plug terminals 1–8, thus preventing the high voltage arc 30 from bridging the gap 15 and causing the spark plugs to fire.

The device 9 may be manufactured of a high resistance dielectric material having an insulating strength of 500 volts or greater per 0.001 inch of thickness, which is commonly known in the art of plastic and ceramic dielectric materials readily available at reasonable costs.

The rotation of the disclosed device 9 in the gap 15 may be accomplished by means of a step motor 16, which may be synchronized with the rotation of the engine camshaft 23 by means of a motor controller 17, which controls the step motor 16, based upon signals received from a photo electric sensor 19, which senses the position of the device 9 by sensing a marking means 18 on the device 9, and based upon signals sent by sensor means 13, picked-up from timing disk 21, which is attached to the engine camshaft 23 and defines the angular position of the engine camshaft 23 and the respective position of the pistons, to determine the proper sequential firing of the spark plugs.

The electronic module 11 analyzes the signals received from sensor means 13 at the camshaft 23 and from sensor means 19 at the rotating device 9, to determine the current position of the engine pistons and the rotating device 9. The electronic module 11, then computes the appropriate time to send a signal to the primary coil of the high voltage ignition coil 12, thus causing the high voltage from the ignition coil 12 to be present at the high voltage terminal 10 at the same time that the aperture 14 through the device 9 is present, which allows a high voltage arc 30 to bridge the gap 15 to the proper spark plug terminal 1–8, thus causing the proper sequential firing of the spark plugs 1–8.

Figure 4:
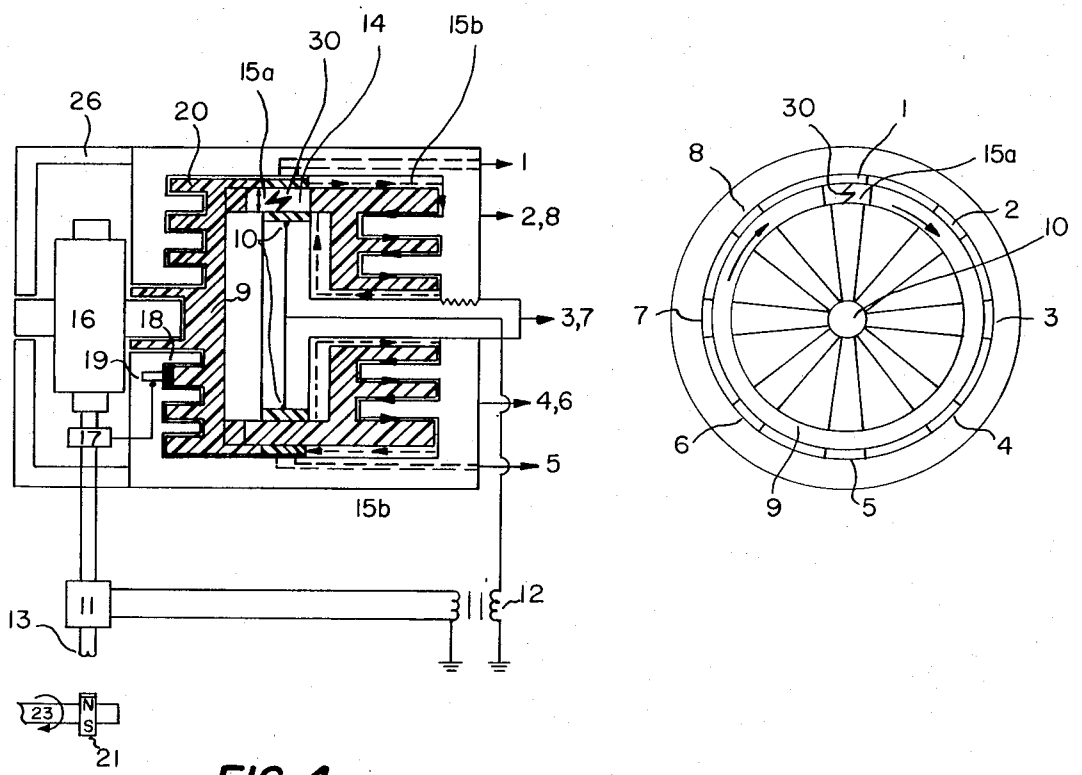
FIG. 4 is an enlarged fragmentary sectional view and diagramatic representation of a second embodiment of the disclosed high resistance, field-interrupting dielectric device shown in operative arrangement with a high voltage ignition coil that can be manufactured of a much smaller diameter than that of FIG. 3 due to the reconfiguration of the fin-type projections on either side of the device which act to increase or decrease the length of the alternate arcing path from the high voltage ignition coil to ground or to the spark plug electrode terminals.

Shown in FIG. 4 is a grammatical representation of a second preferred embodiment of the disclosed invention wherein the overall dimensions and the diameter of the disclosed device 9 have been significantly reduced from the dimensions of FIG. 3 by modifying the length of the alternate conductive path **15*b*. This modification in the length of the alternate conductive path 15*b* may be accomplished by a plurality of fin-type projections 20 off of one side or both sides of the device 9, configured in a cross-sectional zig-zag pattern wherein the length of the alternate conductive path 15*b* is increased without any increase in the overall dimensions of the device 9, thus allowing for a more compact distributor size. This second preferred embodiment may also be utilized in situations where either the high voltage electrode 10 or the spark plug terminals 1–8** must be moving and cannot remain in a fixed position.

Figure 5:
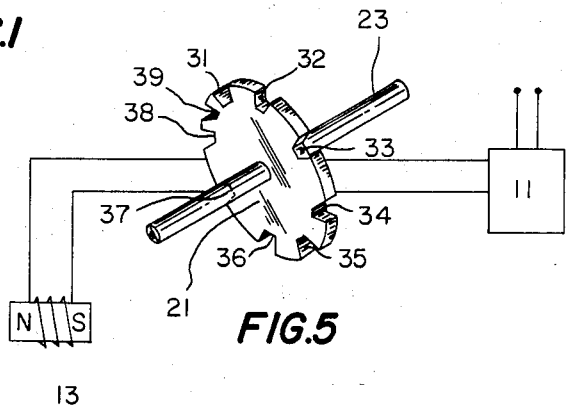
FIG. 5 is a diagramatic drawing and representation of a timing disk means adapted to the camshaft of an internal combustion engine, used to determine the angular position of the camshaft and the proper sequence and firing times for the respective spark plugs.

Shown in FIG. 5 is a diagramatic representation of the timing disk 21 attached to the engine camshaft 23 in operative arrangement with the sensor means 13, which senses the angular position of the camshaft 23 and the corresponding positions of the engine pistons. Sensor means 13 then sends a signal to the electronic module 11 which energizes the high voltage ignition coil 12 at the proper time to cause the sequential firing of the respective spark plugs 1–8.

Figure 6:
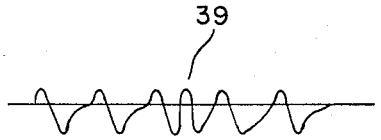
FIG. 6 is a graphical representation of a typical wave-form picked-up by the electronic sensor means adapted to the engine camshaft as shown in FIG. 5.
Figure 7:
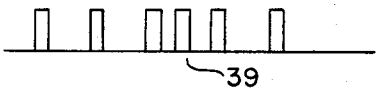
FIG. 7 is a graphical representation of the wave-form shown in FIG. 6 after it has been digitalized by electronic circuitry.
Figure 8:
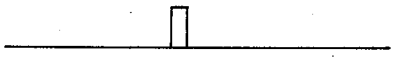
FIG. 8 is a graphical representation of a digitalized pulse train picked-up by the sensing means shown in FIG. 5, which defines the angular position of the camshaft and thus the proper firing sequence of the respective spark plugs.

Shown in FIG. 6 is a graphical representation of the signal sent by the sensor means 13 to the electronic module 11. This signal is digitalized by the electronic module 11 and FIG. 7 shows a graphical representation of the digitalized signal. FIG. 8 shows a graphical representation of the pulse which was generated by notch 39 on the timing disk 21, which allows the electronic module 11 to determine the angular position of the engine camshaft 23 and the corresponding positions of the engine pistons.

Figure 1:
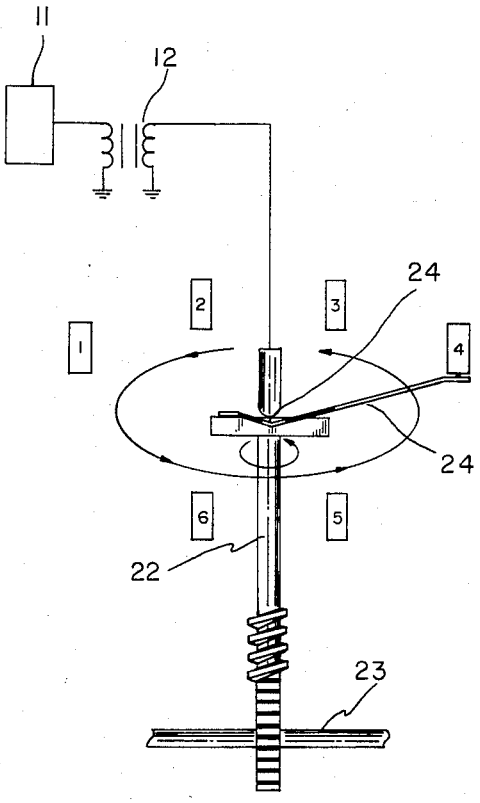
FIG. 1 is a diagramatic perspective view of an existing art type of conventional ignition system for a six cylinder piston type internal combustion engine employing a rotating conductor (rotor) which distributes a high voltage arc from the ignition coil to the electrode terminals of the respective spark plugs, wherein the rotor is directly connected by means of a mechanical linkage to the engine camshaft.
Figure 2:
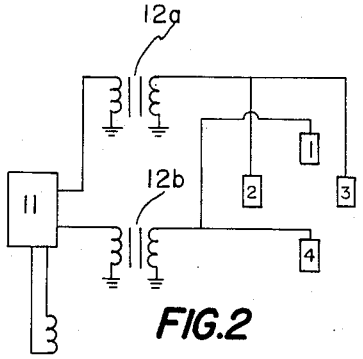
FIG. 2 is a diagramatic perspective view of an existing art type of electronic contactess ignition system for a four cylinder piston type internal combustion engine employing two high voltage ignition coils which deliver a high voltage arc to two separate spark plugs when an electronic controller receives a signal from a sensor means adapted to the engine camshaft.

The preferred embodiments of the disclosed invention as described herein provide for the elimination of a rotating conductor arm (rotor) 24 as shown in FIG. 1 and FIG. 2, and for the elimination of the mechanical linkage 22 between the engine camshaft 23 and the rotor arm 24. The need for multiple high voltage ignition coils **12*a* and 12*b* as shown in FIG. 2**, and for the dual firing of the spark plugs on both the compression and the exhaust cycles, is also eliminated.

The advantages of the disclosed invention as enumerated above, coupled with the advantages of lower production costs, greater reliability, lower service and maintenance costs, and fewer moving parts, make this invention useful and of great benefit to the general public.

The above descriptions of preferred embodiments of the disclosed invention are provided for the purpose of illustrating the general concept of the invention disclosed and are not to be considered or interpreted as limiting the scope of the invention in any manner. Many modifications and variations thereto are possible, all of which fall within the true spirit and scope of the invention. As an example, numerous shapes can be conceived for the high voltage ignition coil electrode, for the opposing spark plug terminal electrodes, and for the shape of the high resistance, field-interrupting dielectric device itself, which may be functional and different from those disclosed in the detailed description of the preferred embodiments. Additionally, numerous means of rotating the high resistance, field-interrupting dielectric device in synchronization with the engine camshaft can be conceived which may be functional and differ greatly from those described in the preferred embodiments. All of these conceivable variations would fall within the true spirit and scope of the invention disclosed.

The embodiments of the invention in which an exclusive property or privilege is claimed are defined as follows:

1. An apparatus for distributing a high voltage arc from the high voltage ignition coil electrode of an internal combustion engine to a plurality of spark plug electrode terminals, comprising:

a high voltage ignition coil electrode connected to a high voltage ignition coil means;

a plurality of spark plug electrode terminals directly opposing said high voltage ignition coil electrode;

said high voltage ignition coil electrode and said plurality of spark plug electrode terminals being in direct opposition to each other and separated from each other by a fixed gap;

a high resistance, field-interrupting dielectric device having opposed surfaces;

said high resistance, field-interrupting dielectric device having an aperture or hole therethrough passing between said opposing surfaces and defining a conductive path between said opposing surfaces;

a means for rotating said high resistance, field-interrupting dielectric device in said fixed gap between said high voltage ignition coil electrode and said plurality of spark plug electrode terminals, in such a manner that said aperture through said device passes directly between said opposing high voltage ignition coil electrode and said plurality of spark plug electrode terminals, allowing a high voltage arc from said high voltage ignition coil electrode to bridge said fixed gap through said aperture causing the respective spark plugs connected to the plurality of spark plug electrode terminals to be fired in the proper sequential manner;

a means for synchronizing the rotation of said high resistance, field-interrupting dielectric device in said fixed gap between said high voltage ignition coil electrode and said plurality of spark plug electrode terminals, with the rotation of the camshaft of said internal combustion engine, in such a manner so as to insure the proper sequential firing of said respective spark plugs.

2. An apparatus for distributing a high voltage arc from the high voltage ignition coil electrode of an internal combustion engine to a plurality of spark plug electrode terminals according to claim 1, wherein said high resistance, field-interrupting dielectric device is of a cylindrical shape having a common axis with said high voltage ignition coil electrode and with said plurality of spark plug electrode terminals, to allow said device to be rotated in said fixed gap between said electrodes.

3. An apparatus for distributing a high voltage arc from the high voltage ignition coil electrode of an internal combustion engine to a plurality of spark plug electrode terminals according to claim 1, wherein said aperture or hole through said high resistance, field-interrupting dielectric device may be filled with a conductive material.

4. An apparatus for distributing a high voltage arc from the high voltage ignition coil electrode of an internal combustion engine to a plurality of spark plug electrode terminals according to claim 2, wherein said high resistance, field-interrupting dielectric device has a plurality of fin-type of projections off one surface or both surfaces of said device which are concentric with each other, have a common axis with said device, and define an alternate conductive path between said opposing surfaces of said device, which is longer than the conductive path defined through said aperture.

5. An apparatus for distributing a high voltage arc from the high voltage ignition coil electrode of an internal combustion engine to a plurality of spark plug electrode terminals according to claim 3, wherein said high resistance, field-interrupting dielectric device may be manufactured from a material having a dielectric strength of 500 volts or greater per each 0.001 inch of thickness of said material.

6. An apparatus for distributing a high voltage arc from the high voltage ignition coil electrode of an internal combustion engine to a plurality of spark plug electrode terminals according to claim 1, wherein said means for rotating said high resistance, field-interrupting dielectric device in said fixed gap between said high voltage ignition coil electrode and said plurality of spark plug electrode terminals may be accomplished by a step motor means and motor controller means synchronized to the rotation of the camshaft of said internal combustion engine.

7. An apparatus for distributing a high voltage arc from the high voltage ignition coil electrode of an internal combustion engine to a plurality of spark plug electrode terminals according to claim 6, wherein said means for synchronizing the rotation of said high resistance, field-interrupting dielectric device with the rotation of the camshaft of said internal combustion engine, may be accomplished by a sensor means to determine the angular position of the engine camshaft, a sensor means to determine the position of said rotating device, and an electronic circuitry means to analyze data received from said sensor means and control said step motor means, to maintain proper synchronization.

* * * * *